US007621221B2

(12) United States Patent
Ritman

(10) Patent No.: US 7,621,221 B2
(45) Date of Patent: Nov. 24, 2009

(54) DOUBLE EXPLOSIVELY-FORMED RING (DEFR) WARHEAD

(75) Inventor: Zeev Ritman, Haifa (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 437 days.

(21) Appl. No.: 10/543,331

(22) PCT Filed: Jan. 29, 2004

(86) PCT No.: PCT/IL2004/000085

§ 371 (c)(1),
(2), (4) Date: Jul. 25, 2005

(87) PCT Pub. No.: WO2004/070311

PCT Pub. Date: Aug. 19, 2004

(65) Prior Publication Data

US 2006/0137562 A1 Jun. 29, 2006

(30) Foreign Application Priority Data

Feb. 2, 2003 (IL) ..... 154247

(51) Int. Cl.
*F42B 12/02* (2006.01)

(52) U.S. Cl. ..... 102/475; 102/306; 102/476

(58) Field of Classification Search ..... 102/475, 102/476, 305–310; 89/1.15
See application file for complete search history.

(56) References Cited

U.S. PATENT DOCUMENTS 2,757,611 A * 8/1956 Church et al. ..... 102/307
3,244,102 A * 4/1966 Wofford, III et al. ..... 102/307
3,477,372 A * 11/1969 Nelson et al. ..... 102/307
3,974,771 A * 8/1976 Thomanek ..... 102/494
3,977,330 A * 8/1976 Held ..... 102/210
4,590,861 A 5/1986 Bugiel
5,320,044 A * 6/1994 Walters ..... 102/475
5,559,304 A 9/1996 Schweiger
5,792,980 A 8/1998 Weimann
6,477,959 B1 11/2002 Ritman
6,668,727 B1 * 12/2003 Kim et al. ..... 102/482
6,758,143 B2 * 7/2004 Ritman et al. ..... 102/476

FOREIGN PATENT DOCUMENTS

EP 1128155 A2 * 8/2001
WO WO0163199 * 8/2001

* cited by examiner

*Primary Examiner*—Michelle Clement
(74) *Attorney, Agent, or Firm*—Mark M. Friedman

(57) ABSTRACT

A warhead configuration for forming a hole through a wall of a target, the warhead configuration comprising a charge of explosive material and a liner. The charge has an axis and a front surface. The front surface includes two annular front surface portions, an inner and an outer annular portion, circumscribing the axis. Each of the annular front surface portions is configured so as to exhibit a concave profile as viewed in a cross-section through the charge parallel to the axis. The liner includes a first liner disposed adjacent to the inner annular portion and a second liner disposed adjacent to the outer annular portion such that, when the charge is detonated, material from the first liner is formed into a first expanding explosively formed ring and material from the second liner is formed into a second explosively formed ring.

20 Claims, 10 Drawing Sheets

DOUBLE EXPLOSIVELY-FORMED RING (DEFR) WARHEAD

FIELD AND BACKGROUND OF THE INVENTION

The present invention relates to warheads and, in particular it concerns warheads having cutting and breaching effects.

Of relevance to the present invention is the Explosively Formed Penetrator (EFP) warhead, also known as Self-Forging Fragment (SFF) warhead. EFP's are taught by U.S. Pat. No. 4,590,861 to Bugiel, U.S. Pat. No. 5,792,980 to Weimann and U.S. Pat. No. 5,559,304 to Schweiger, et al. EFP's consist of an essentially axi-symmetric explosive charge with a concave cavity at its forward end being lined by a metallic liner. Upon detonation of the charge, the liner deforms under the effect of the detonation forming a projectile that is accelerated in the axial direction. When properly designed, such a projectile is stable and its effective range can be several hundreds of charge diameters. According to the same principle, reference is now made to FIG. 1, which is an axial-sectional view of a wall breaching warhead 10 which is constructed in accordance with the prior art. Wall breaching warhead 10 is described in U.S. Pat. No. 6,477,959 to Ritman, et al., which is incorporated by reference for all purposes as if fully set forth herein. Generally speaking, wall-breaching warhead 10 includes a charge 14 of explosive material having a central axis 16. The front surface of charge 14 includes a central portion 18, adjacent to central axis 16, having a generally convexly-curved shape, and an annular portion 20, circumscribing central portion 18, having a generally concavely-curved shape. A metallic liner 22 is disposed adjacent to at least annular portion 20 of the front surface of charge 14. The effect of concavely-curved annular portion 20 is to substantially concentrate a major part of the material from metallic liner 22 into an expanding conical path. In preferred cases, metallic liner 22 deforms plastically into an expanding explosively formed ring ("EFR"). In other words, after detonation of charge 14, metallic liner 22 expands along a generatrix 24 of cone 26, which is defined by the centerline of annular portion 20, diverging from the central axis 16 and stretches until it is fragmented. Subsequently the fragments continue their motion in the same direction. Reference numerals 28, 30, 32 and 34 depict the condition and displacement of metallic liner 22 at consecutive instants in time after detonation. The ring generally advances at a speed of roughly 2000 m/s, cutting a hole through the front layers of a wall. The EFR therefore serves as a cutting charge, nicknamed "cookie-cutter", in applications such as a wall-breaching charge opening a hole in a brick wall. In addition, convexly-curved central portion 18 produces a spherical blast wave that breaks the rear wall layers by a scabbing effect. The spherical blast wave together with the EFR also assists in knocking out the weakened front layer.

Reference is now made to FIG. 2*a*, which is an axial sectional view of wall breaching warhead 10 detonated at an adequate standoff $CC_1$ from a target 36 where central axis 16 is perpendicular to target 36 in accordance with the prior art. The slant ranges $AA_1$, $BB_1$, traveled along any cone generatrix 24, by the various elements of the ring circumference, are equal to each other.

Reference is now made to FIG. 2*b*, which is a front view of target 36 shortly after wall breaching warhead 10 was detonated at an adequate standoff $CC_1$ (FIG. 2*a*) from target 36, where central axis 16 is perpendicular to target 36 in accordance with the prior art. A footprint 38 of metallic liner 22 (FIG. 1) on target 36 is of circular shape. A circular hole is created by footprint 38 which is evenly cut into target 36 around the circumference of footprint 38.

Unlike the EFP, the performance of the EFR is highly sensitive to the slant range traveled by its fragments, as the fragments are not aerodynamically stable and their density drops as the distance traveled increases. Therefore, the standoff distance of an EFR charge, which is defined by the distance between the charge and the target, is an important parameter since at excessive standoff distances the fragments will be unable to cut through the target. In addition, as further illustrated in FIGS. 3*a* and 3*b* below, the performance of an EFR warhead is sensitive to the obliquity of the warhead axis relative to the target.

Reference is now made to FIG. 3*a* which is a side view of wall breaching warhead 10 detonated at a standoff distance $CC_2$, which is equal to standoff distance $CC_1$ of FIG. 2*a*, where central axis 16 is aligned with the surface of a target 40 with high obliquity in accordance with the prior art. Distances $AA_2$, $BB_2$, traveled along cone generatrices 42, 44, respectively, by the various elements of the ring circumference, are not equal to each other. Reference is also made to FIG. 3*b*, which is a front view of target 40 shortly after wall breaching warhead 10 was detonated at stand-off distance $CC_2$ where central axis 16 is aligned with the surface of target 40 with high obliquity in accordance with the prior art. A footprint 46 of metallic liner 22 on target 40 has an elliptical shape. Target 40 is unevenly cut around the circumference of footprint 46. Specifically, at a point $A_2$, which corresponds to the ring elements of metallic liner 22 impacting at the shortest slant range $AA_2$ (FIG. 3*a*), as well as along a portion of footprint 46 corresponding to elliptical curves $A_2G_2$ and $A_2H_2$, target 40 is cut through. On the other hand, at the point $B_2$, which corresponds to the ring elements of metallic liner 22 impacting at the longest slant range $BB_2$, as well as along a portion of the ellipse corresponding to the elliptical curves $B_2G_2$ and $B_2H_2$, the energy of the ring elements is insufficient to cut through target 40. At point $B_2$ and nearby, the ring elements of metallic liner 22 only cause superficial dents in target 40. Moving from point $B_2$ toward points $G_2$ and $H_2$, the depth of the dents; increases gradually until at points $G_2$ and $H_2$ the crater depth is sufficient to cut through target 40. Therefore, detonating an EFR warhead at high obliquity to a target is generally not effective in making a hole in a target.

There is therefore a need for a warhead, which can make holes in a target even when the warhead is aligned obliquely to the target. This need is of special importance in the context of MOUT (Military Operation in Urban Terrain), which requires the breaching of walls by firing stand-off weapons with wall-breaching capability from various aspect angles as determined by operational conditions.

SUMMARY OF THE INVENTION

The present invention is a warhead construction.

According to the teachings of the present invention there is provided, a warhead configuration for forming a hole through a wall of a target, the warhead configuration comprising: (a) a charge of explosive material, the charge having an axis and a front surface, the front surface including two annular front surface portions circumscribing the axis, one of the annular front surface portions being an inner annular portion, another of the annular front surface portions being an outer annular portion, the inner annular portion being disposed between the axis and the outer annular portion, each of the two annular front surface portions being configured so as to exhibit a concave profile as viewed in a cross-section through the charge parallel to the axis, at least part of the concave profile being configured such that a vector projecting outward from the part normal to the annular front surface portion diverges from the axis; and (b) a liner including a first liner disposed adjacent to at least part of the inner annular portion and a second liner disposed adjacent to at least part of the outer annular portion, such that, when the charge is detonated, material from the first liner is formed into a first expanding explosively formed ring and material from the second liner is formed into a second expanding explosively formed ring.

According to a further feature of the present invention the axis is disposed obliquely to a surface of the wall during detonation of the charge.

According to a further feature of the present invention: (a) a first average vector is defined as the vector average of two vectors projecting normally outward from opposite extremes of the concave profile of the inner annular portion; a second average vector is defined as the vector average of two vectors projecting normally outward from opposite extremes of the concave profile of the outer annular portion; (b) a first angle is defined as an angle between the first average vector and the axis; (c) a second angle is defined as an angle between the second average vector and the axis; and (d) the second angle exceeds the first angle by at least 5°.

According to a further feature of the present invention: (a) the first expanding explosively formed ring exhibits a first expanding conical path having a first angle relative to the axis; (b) the second expanding explosively formed ring exhibits a second expanding conical path having a second angle relative to the axis; and (c) the second angle exceeds the first angle by at least 5 degrees.

According to a further feature of the present invention the two annular front surface portions are substantially rotationally symmetric about the axis.

According to a further feature of the present invention the concave profile corresponds substantially to an arc of a circle.

According to a further feature of the present invention the arc subtends an angle of between 15° and 90° to a center of curvature of the arc.

According to a further feature of the present invention the arc subtends an angle of between 30° and 70° to a center of curvature of the arc.

According to a further feature of the present invention the concave profile turns through an angle of between 15° and 90°

According to a further feature of the present invention the concave profile turns through an angle of between 30° and 70°

According to a further feature of the present invention the two annular front surface portions correspond to at least about two-thirds of the total front surface of the charge as viewed parallel to the axis.

According to a further feature of the present invention the two annular front surface portions correspond to at least about 90% of the total front surface of the charge as viewed parallel to the axis.

According to a further feature of the present invention the charge and the liner are configured such that detonation of the explosive material imparts a velocity to the liner of between about 1000 and about 4000 meters per second.

According to a further feature of the present invention a central portion adjacent to the central axis having a generally convexly curved shape.

According to a further feature of the present invention, the charge includes between about ½ kg and about 3 kg of explosive material.

According to a further feature of the present invention, the charge includes less than about 2 kg of explosive material.

According to a further feature of the present invention, there is also provided a stand off detonation system including means for defining a stand off detonation distance of the charge from the wall.

According to a further feature of the present invention, the means for defining a stand off detonation distance includes a stand off rod projecting from the front surface substantially parallel to the axis.

According to a further feature of the present invention, the charge has a rear surface, the warhead further comprising a rear cover associated with at least the rear surface, the rear cover being formed from a non-fragmenting material.

According to the teachings of the present invention there is also provided a warhead configuration for forming a hole through a wall of a target, the warhead configuration comprising: (a) a charge of explosive material, the charge having an axis and presenting a front portion; and (b) a liner disposed adjacent to at least part of the front portion, wherein the charge and the liner are configured such that, when the charge is detonated, a majority of material from the liner forms two expanding explosively formed rings.

According to a further feature of the present invention: (a) one of the two expanding explosively formed rings exhibits a first expanding conical path having a first angle relative to the axis; (b) another of the two expanding explosively formed rings exhibits a second expanding conical path having a second angle relative to the axis; and (c) the second angle exceeds the first angle by at least 5 degrees.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a warhead construction.

The principles and operation of a warhead construction according to the present invention may be better understood with reference to the drawings and the accompanying description.

Figure 1:
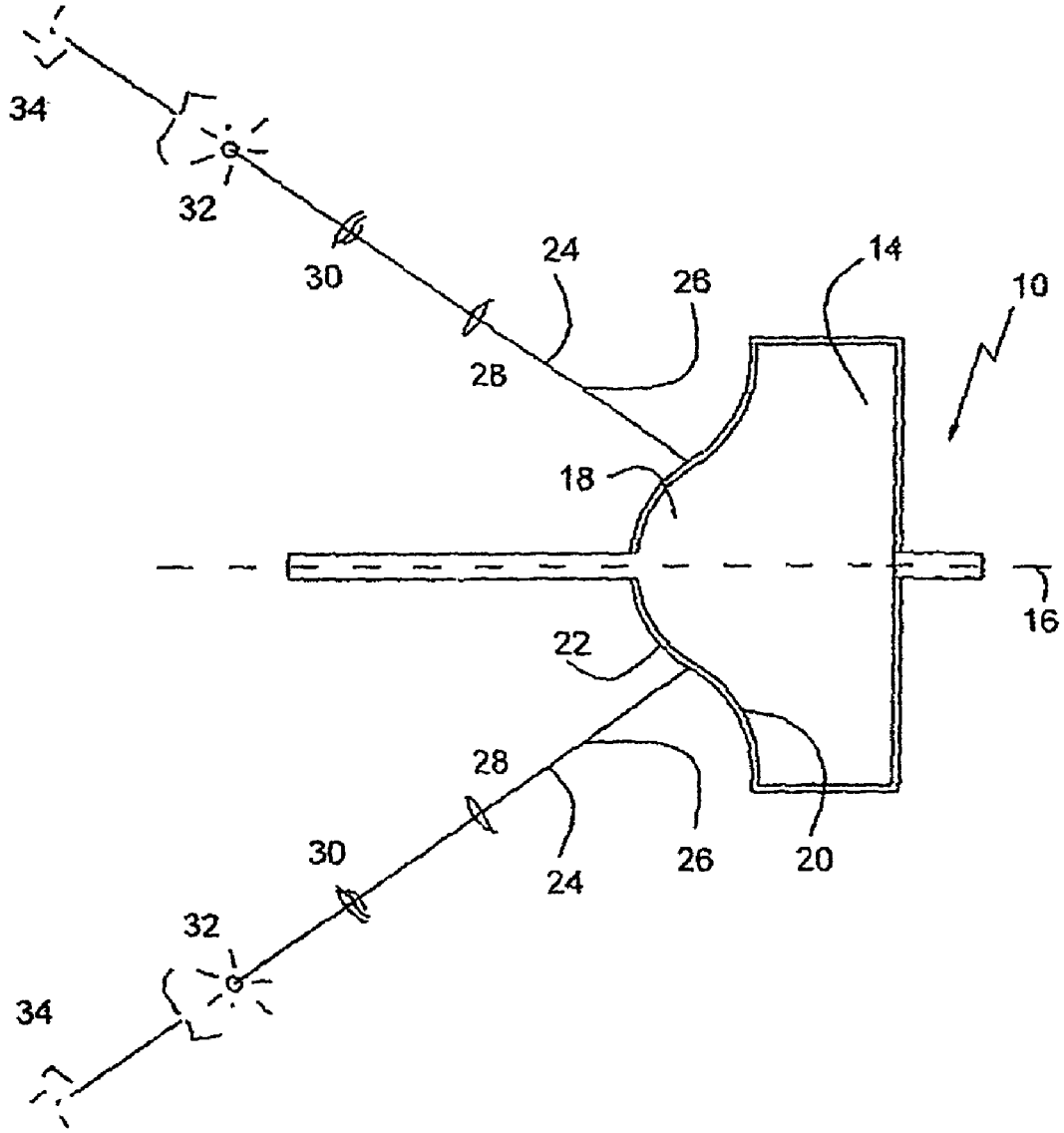
FIG. 1 (PRIOR ART)
FIG. 1 is an axial-sectional view of a wall breaching warhead which is constructed in accordance with the prior art.
Figure 2A:
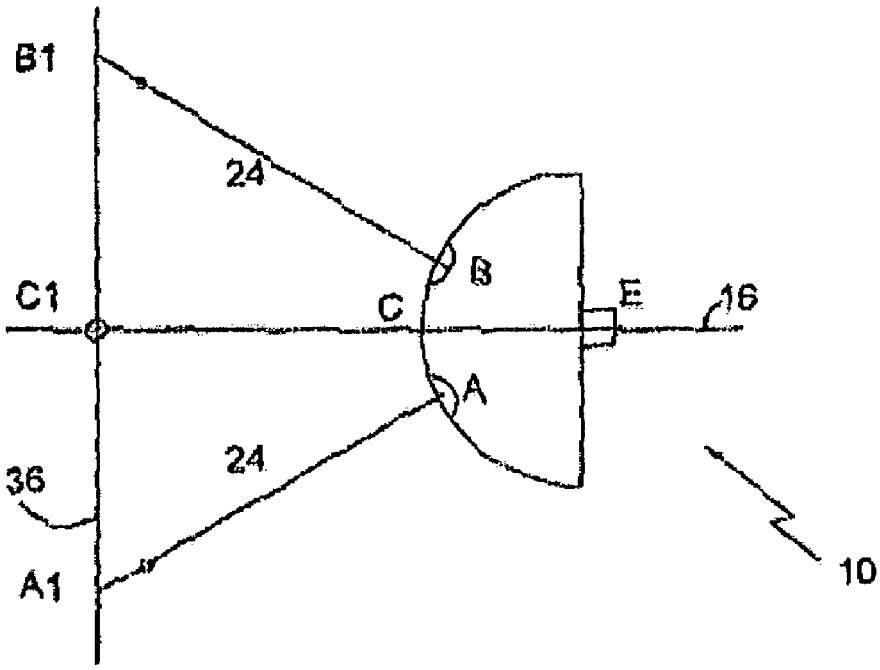
FIG. 2a (PRIOR ART)
FIG. 2*a* is an axial sectional view of the wall breaching warhead of FIG. 1 detonated at an adequate standoff distance from a target where the central axis of the warhead is perpendicular to the target.
Figure 2B:
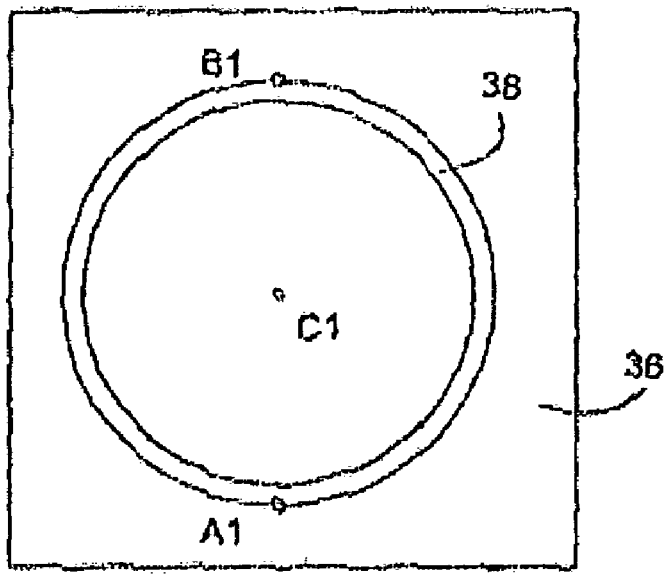
FIG. 2b (PRIOR ART)
FIG. 2*b* is a front view of a target shortly after the wall breaching warhead of FIG. 1 was detonated at an adequate standoff from the target, where the central axis of the warhead is perpendicular to the target.
Figure 3A:
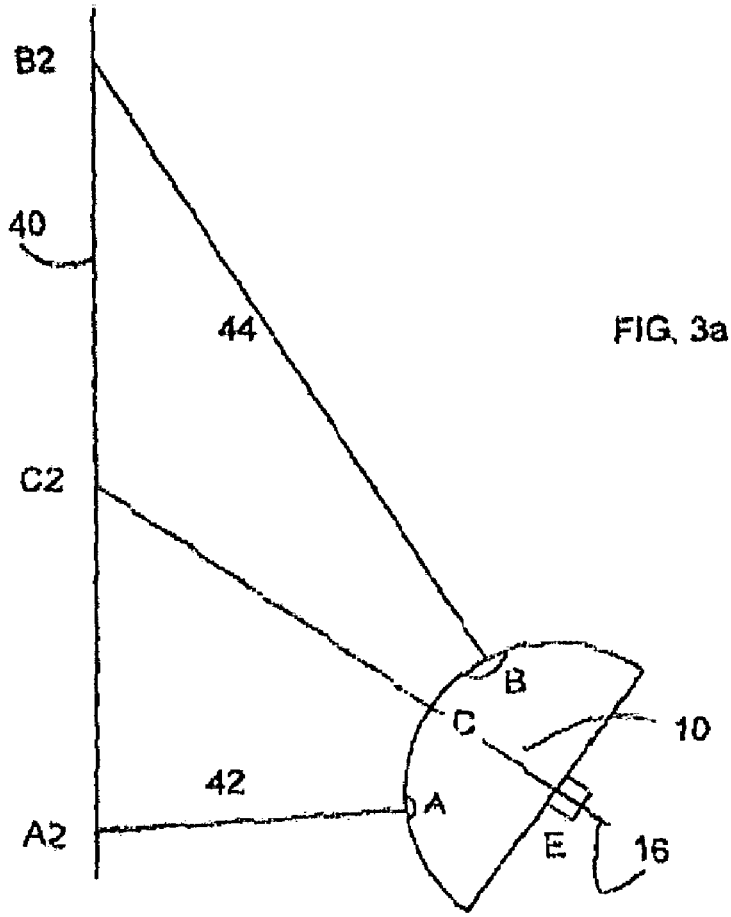
FIG. 3a (PRIOR ART)
FIG. 3*a* is a side view of the wall breaching warhead of FIG. 1 detonated at a standoff distance, where the central axis of the warhead is aligned with the surface of a target with high obliquity.
Figure 3B:
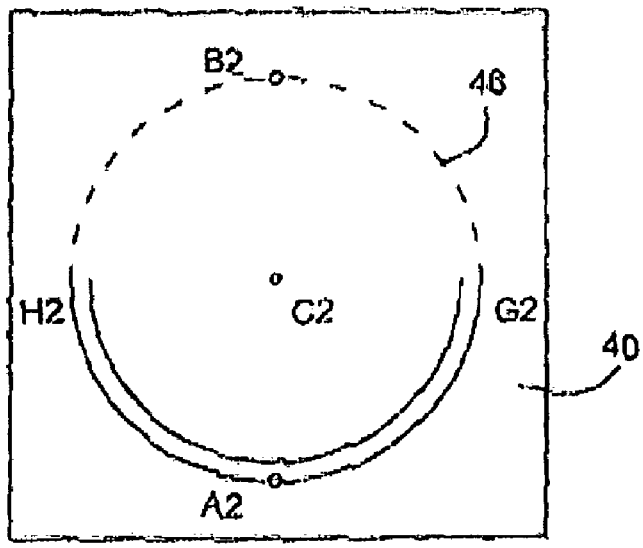
FIG. 3b (PRIOR ART)
FIG. 3*b* is a front view of a target shortly after wall breaching warhead was detonated at a stand-off distance, where the central axis of the warhead is aligned with the surface of the target with high obliquity.
Figure 4:
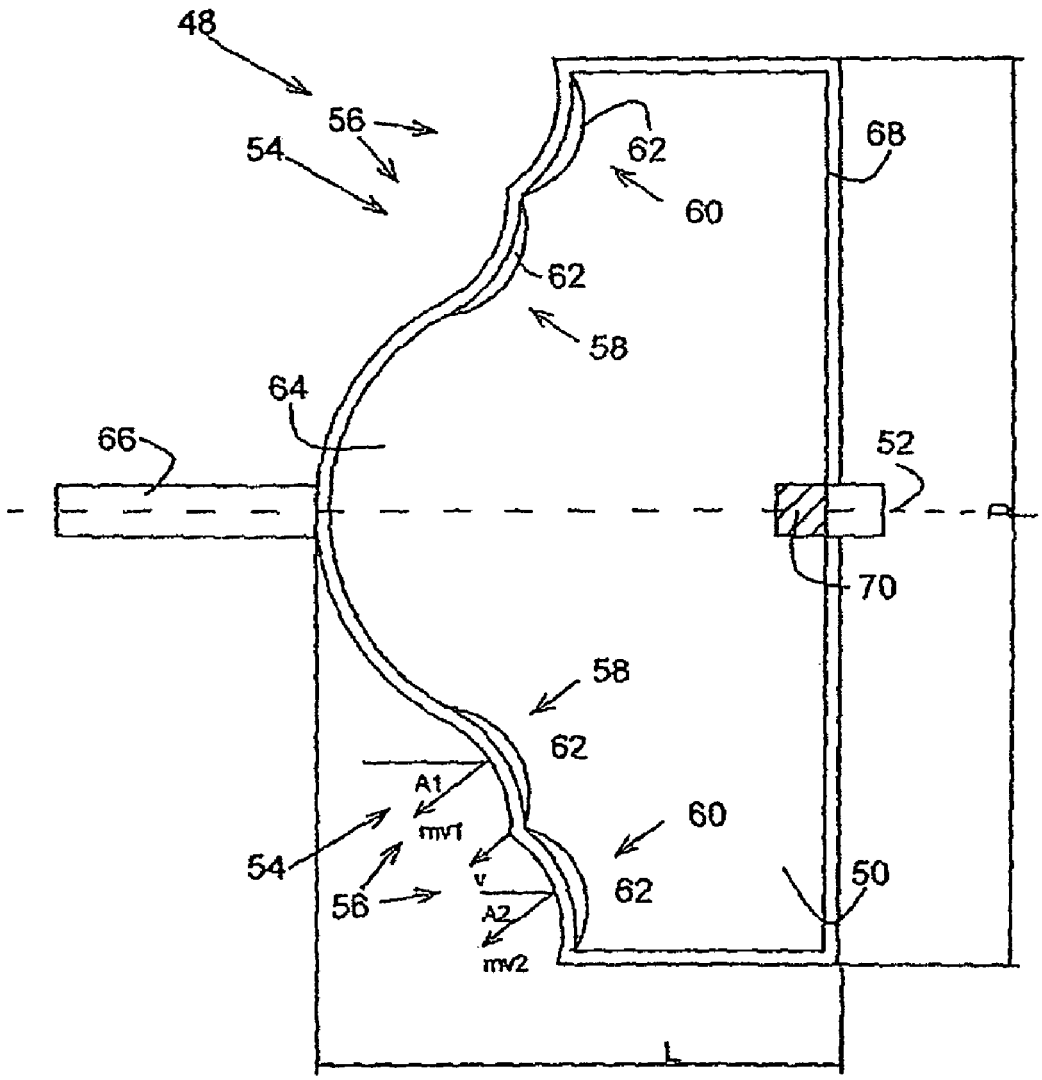
FIG. 4 is an axial-sectional view of a double explosively-formed ring (DEFR) warhead that is constructed and operable in accordance with a preferred embodiment of the invention.
Figure 7A:
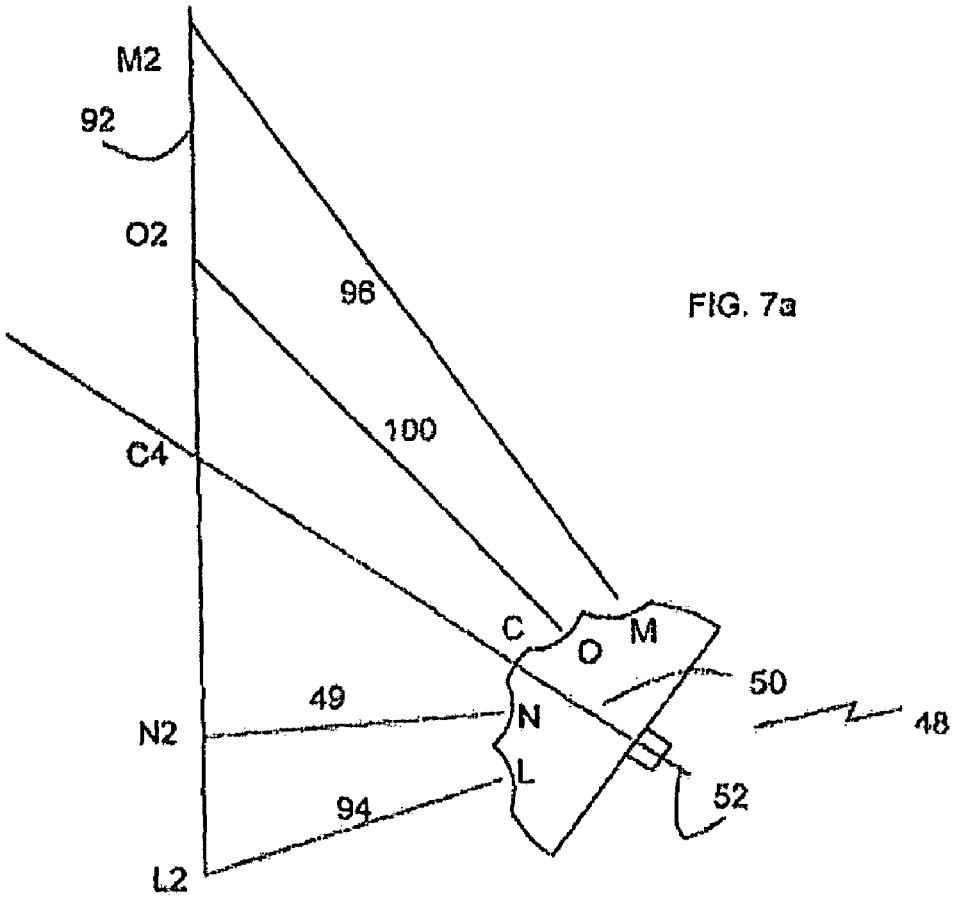
FIG. 7*a* is a schematic cross-sectional view of the DEFR warhead of FIG. 4 shortly after detonation, where the axis of the warhead is aligned obliquely to a target.
Figure 7B:
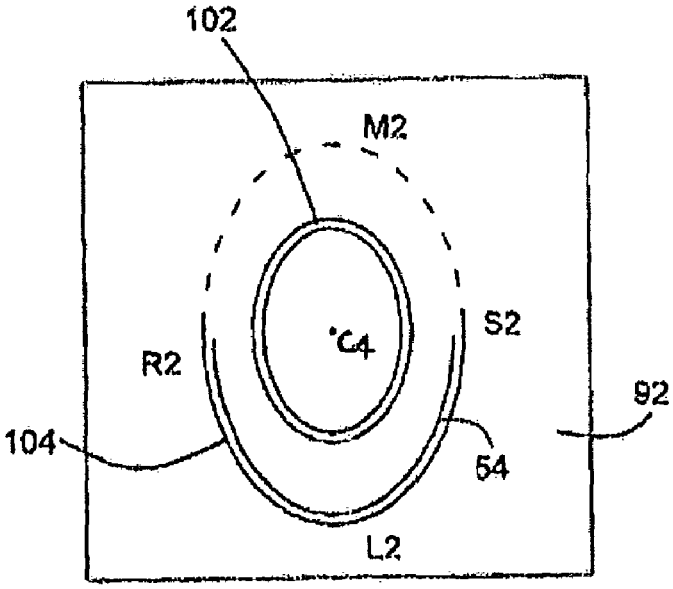
FIG. 7*b* is a schematic front view of the footprints formed by the DEFR warhead on the target of FIG. 7*a;*
Figure 7C:
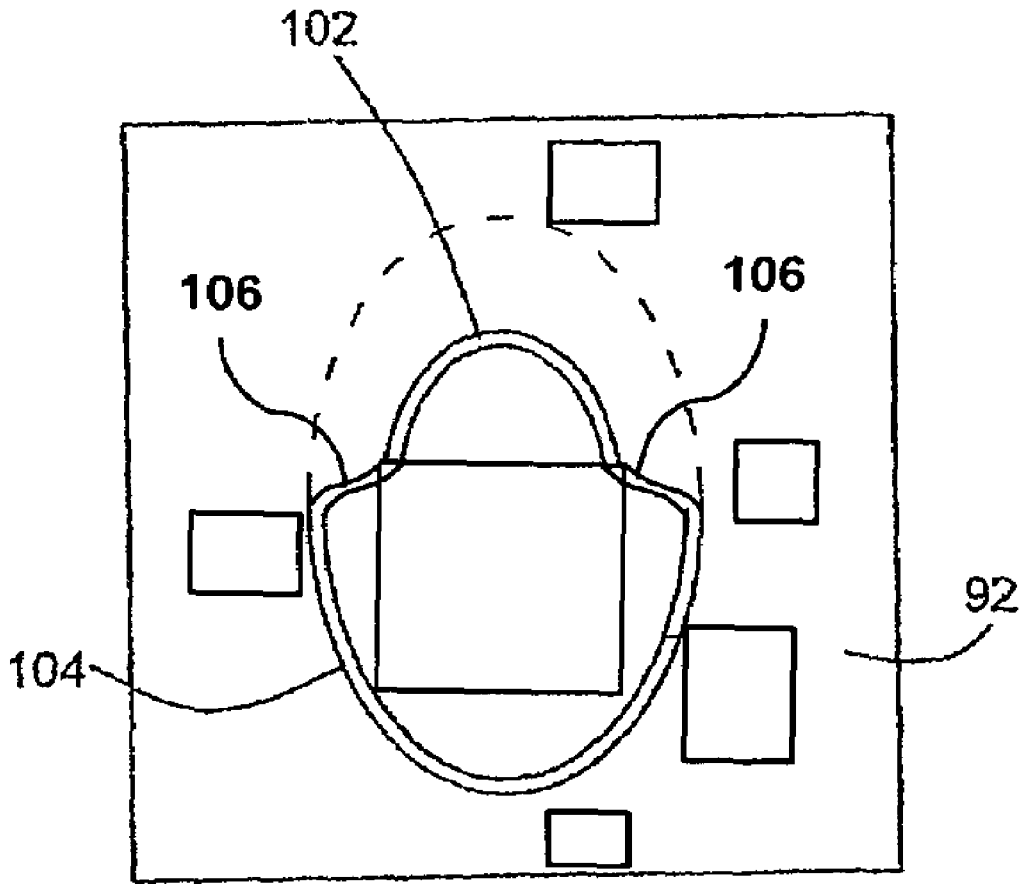
FIG. 7*c* is a schematic front view of the final damage caused to the target of FIG. 7*a*.
Figure 8:
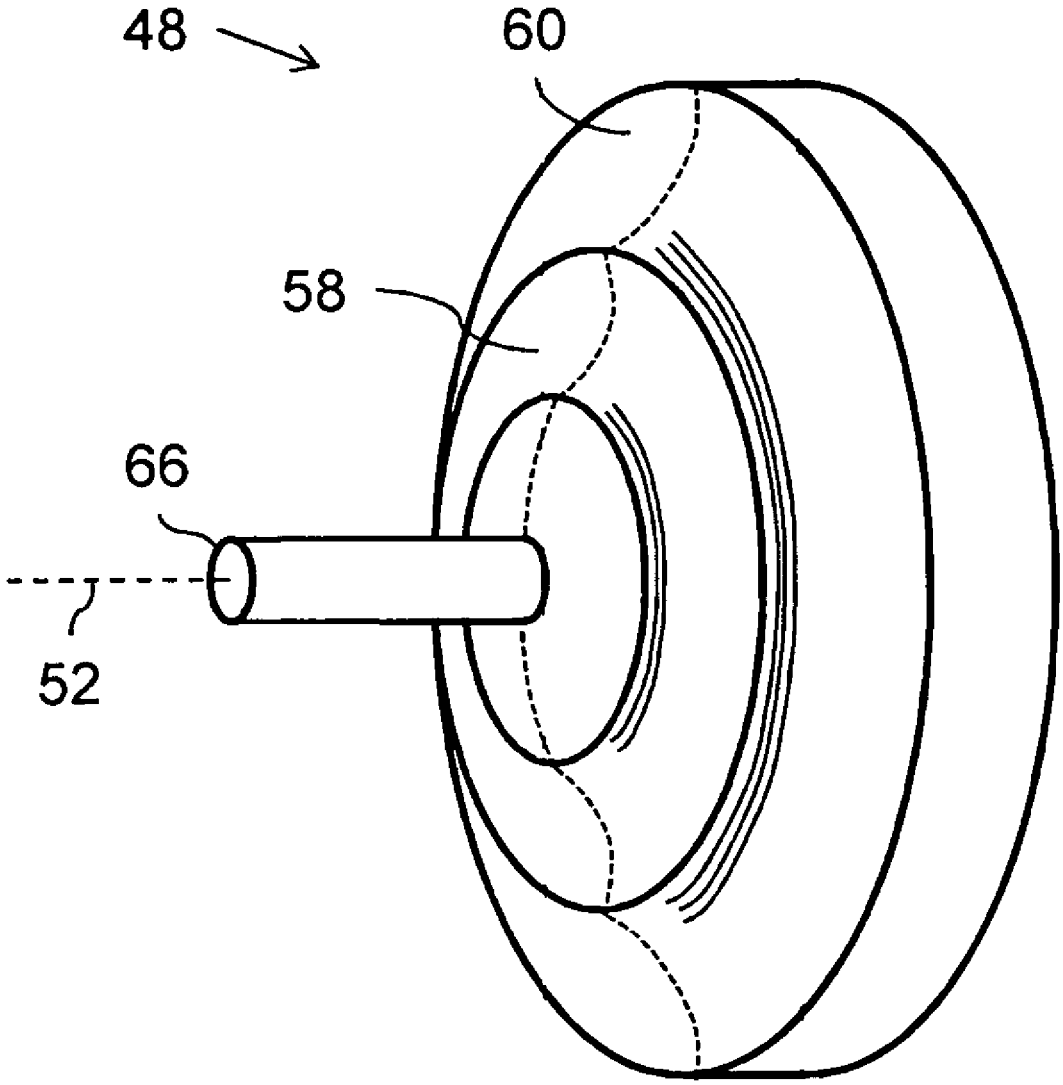
FIG. 8 is an isometric view of the DEFR warhead of FIG. 4.

Reference is now made to FIG. 4, which is an axial-sectional view of a double explosively-formed ring (DEFR) warhead 48 that is constructed and operable in accordance with a preferred embodiment of the invention, and FIG. 8 which is an isometric view of the same warhead. Warhead 48 includes a charge 50 of explosive material. Charge 50 has an axis 52 and a front surface 54. Front surface 54 includes two annular front surface portions 56 circumscribing axis 52. One annular front surface portion 56 is an inner annular portion 58. Another annular front surface portion 56 is an outer annular portion 60. Inner annular portion 58 is disposed between axis 52 and outer annular portion 60. Each annular front surface portion 56 is configured so as to exhibit a concave profile as viewed in a cross-section through charge 50 parallel to axis 52. The concave profile of inner annular portion 58 and the concave profile of outer annular portion 60 are substantially rotationally symmetric about axis 52. Charge 50 also includes a central portion 64 adjacent to axis 52. Central portion 64 has a generally convexly-curved shape. A liner 62 is disposed adjacent to inner annular portion 58 and a liner 63 is disposed adjacent to outer annular portion 60. Liners 62, 63 are typically formed as separate elements, each of which being formed from the same or different materials. Alternatively, liners 62, 63 are formed as part of a continuous metal cover lining the front side of the explosive charge. Preferably, liners 62, 63 at least cover substantially the entirety of annular front surface portions 56. When charge 50 is detonated, material from liner 62 and liner 63 is concentrated by inner annular portion 58 and outer annular portion 60, respectively, to form two expanding explosively formed rings or double explosively formed rings (DEFR), which advance at a speed of roughly 2,000 meters per second, enabling wall breaching warhead 48 to cut into the front layers of a wall. The types of materials to be used for liners 62, 63 may include, but are not limited to, metals such as copper, tantalum, aluminum, iron, tungsten, molybdenum and metallic alloys as well as ceramic materials, plastic materials, composites and pressed powder materials. In addition, on detonation, convexly-curved central portion 64 produces a spherical blast wave that breaks the rear wall layers by a scabbing effect. The combination of these two effects provides a very effective tool for breaching brick walls. The arrival of the blast wave together with the DEFR also assists in knocking out the weakened front layer, even when axis 52 is aligned obliquely to the surface of a wall, as will be explained later with reference to FIGS. 7*a*, 7*b* and 7*c*.

Before turning to features of the present invention in more detail, it should be appreciated that the invention is useful for breaching a wide variety of types of walls in different circumstances. Although not limited thereto, the invention is believed to be of particular value for breaching brick walls. In this context, it should be noted that the term "brick wall" is used herein in the description and claims to refer generically to any wall constructed of one or more layer of relatively small units piled in overlapping formation. The term is used irrespective of the particular material used for the units, whether it is "brick", stone, or slabs or blocks of any other construction material. The term is also used to include composite walls in which one or more layer of a brick-like formation is used together with other structural or insulation elements.

Turning now to the features of wall breaching warhead 48 in more detail, inner annular portion 58 and outer annular portion 60 each exhibit a concave profile as viewed in a cross-section through charge 50 passing through axis 52. Each concave profile is generally configured such that a vector, v, projecting outward from the concave profile, normal to the corresponding annular front surface portion 56 diverges from axis 52. Additionally, an average vector $mv_1$ is defined as the vector average of two vectors Va, Vb which project normally outward from opposite extremes 67, 69 of the concave profile of inner annular portion 58. Similarly, the concave profile of outer annular portion 60 has a similarly defined average vector $mv_2$. An angle $A_1$ is defined as an angle between vector $mv_1$ and axis 52. An angle $A_2$ is defined as an angle between vector $mv_2$ and axis 52. For most embodiments of the concave profiles, angle $A_2$ exceeds angle $A_1$. In order to effectively produce two distinct explosively formed rings, angle $A_2$ generally exceeds angle $A_1$ by at least 5°. As a reasonable approximation, inner annular portion 58 produces an explosively formed ring, which exhibits an expanding conical path with angle $A_1$ relative to axis 52. Similarly, outer annular portion 60 produces an explosively formed ring, which exhibits an expanding conical path with angle $A_2$ relative to axis 52. However, the exact angles of the expanding conical paths will depend on various factors such as the geometry of the point of initiation relative to the shaped surfaces, as will be discussed below. The converging vectors of the concave profiles of inner annular portion 58 and outer annular portion 60, approximate closely to the direction of the explosive thrust experienced by the different parts of liner 62 and liner 63, respectively, leading to liner 62 forming an inner concentric ring and liner 63 forming an outer concentric ring. These concentric rings form the expanding DEFR. The rings may break into fragments as they expand. However, the fragments of each ring are still generally sufficiently close together to perform a cutting action through the wall.

Additionally, the concave profile of each annular front surface portion 56 turns through no more than 90°. Typically, each concave profile corresponds substantially to an arc of a circle, which subtends an angle of between 15° and 90° to the center of curvature of the arc. In other words, each concave profile typically turns through an angle of between 15° and 90°. Preferably, the arc of the circle subtends an angle of between 30° and 70° to the center of curvature of the arc. In other words, each concave profile preferably turns through an angle of between 30° and 70°.

In order to allow spreading of the DEFR to cut a hole of the desired size, charge 50 should be detonated at a predefined distance from the surface of the wall to be breached. To this end, certain preferred implementations of warhead 48 include a stand off rod 66 projecting from the front surface substantially parallel to axis 52. Stand off rod 66 is configured to define a stand off detonation distance of charge 50 from the wall, as is known in the art. Clearly, alternative implementations may achieve a similar effect using other techniques for detonating the charge at a predefined distance. Possible examples include, but are not limited to, systems employing optical or electromagnetic (radio frequency) proximity sensors.

It should be appreciated that the combination of the cutting effect of the EFR together with the blast effect of the central portion of the shaped charge provides a highly efficient breaching effect. Thus, in striking contrast to quantities of 10-20 kg which would be required if a conventional blast charge were used, the shaped charge of the present invention preferably includes between about ½ kg and about 3 kg of explosive material, and most preferably less than about 2 kg. This charge is light enough to be carried by a rocket or missile designed for carrying only a few kg of explosive, thereby avoiding the need to send the operating force to the wall.

As mentioned before, liners 62, 63 are adjacent to inner annular portion 58 and outer annular portion 60, respectively. This typically corresponds to at least about two-thirds, and preferably 90% of the total area of the front surface as viewed parallel to axis 52. The rear surface of charge 50 may be substantially flat or of a conical shape. The rear surface of charge 50 is preferably covered by a rear cover 68 formed from non-fragmenting material. In this context, "non-fragmenting" is used to refer to materials, which do not generally form fragments that could pose a danger to the operating force. Rear cover 68 may extend to the front surface of charge 50 to form a continuous protective envelope, which covers liners 62, 63 as well. Liners 62, 63 are preferably mechanically connected, typically using adhesive, onto the protective envelope prior to loading the charge 50 therein. Alternatively, the forward part of the protective envelope is formed integrally with liners 62, 63 and the rear part of the protective envelope is formed from non-fragmenting materials, such as plastic materials. An explosive booster 70 is installed at the rear side of charge 50. Optionally, the rear side of charge 50 includes a more complex initiation system (not shown) including a wave-shaper (not shown) for peripheral initiation. The wave-shaper also includes an explosive duct along its centerline providing a central wave-source to liner 62 which is adjacent to inner annular portion 58 and a peripheral wave source to liner 63 which is adjacent to outer annular portion 60. The rear side of charge 50 has mechanical and pyrotechnic interfaces (not shown). The design of rear cover 68, the initiation system, the detonation chain and the interfaces are well-known to those skilled in the art of warhead systems.

It will be noted that the explosive thrust experienced by liners 62, 63 is also influenced by the geometry of the point of initiation relative to the shaped surfaces. In the preferred example shown here, charge 50 is made relatively flat. In more quantitative terms, an outer diameter D of charge 50 measured perpendicular to axis 52 is preferably about twice the maximum length L of charge 50 measured parallel to axis 52. The use of point initiation in the middle of the back surface of charge 50 tends to increase the conical angle (i.e., angles of divergence) of the DEFR. The various physical properties influencing the formation and properties of the DEFR, including the shape of charge 50, the point of detonation, the material and thickness distribution of the liner, and the type and amount of explosive used, are preferable chosen to impart a velocity to parts of liners 62, 63 of between about 1000 and about 4000 m/s, and most preferably, of about 2000 m/s.

Figure 5:
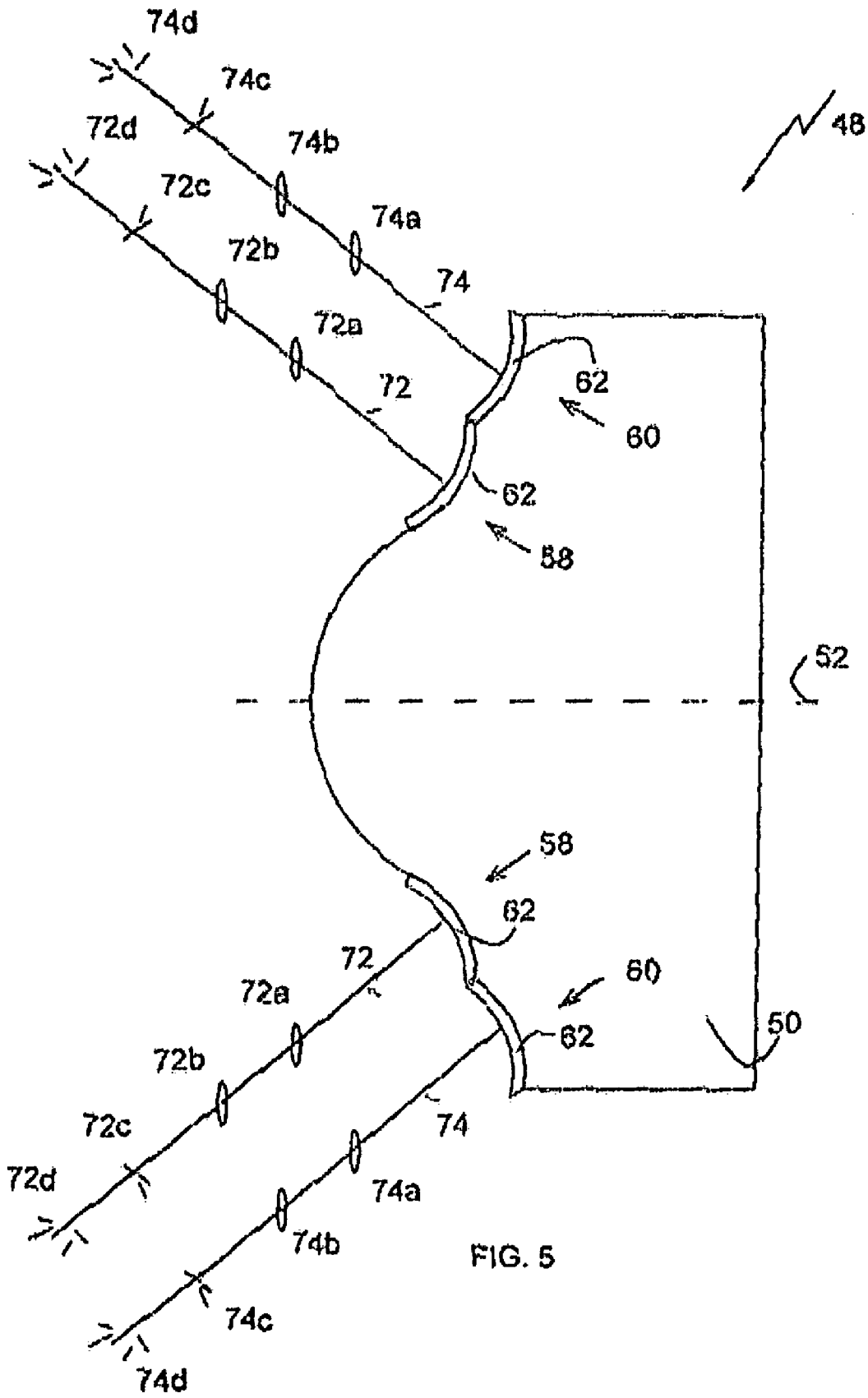
FIG. 5 is a schematic axial-sectional view of the DEFR warhead of FIG. 4 shortly after detonation.

Reference is now made to FIG. 5, which is a schematic axial-sectional view of warhead 48 of FIG. 4 shortly after detonation. Warhead 48 is described as a Double Explosively-Formed Ring (DEFR) warhead, as it generates two annular ring-shaped projectiles upon detonation. Each element in the rings, formed from liner 62 and liner 63 adjacent to inner annular portion 58 and outer annular portion 60, respectively, moves in a direction essentially aligned to the centerline of the cavity of each ring. Therefore, liner 62 and liner 63 expand along generatrices 72 and 74 of the cones defined by the cavity centerlines, respectively. The cones stretch until they are fragmented. Generatrices 72, 74 diverge from axis 52. The angle of divergence of the outer cavity from axis 52 is larger than the angle of divergence of the inner cavity from axis 52 as discussed above with reference to FIG. 4. Subsequently, the fragments continue their motion in the same direction. Reference numerals 72*a*, 72*b*, 72*c*, 72*d* depict the condition and displacement of liner 62 at consecutive instants in time after detonation. Reference numerals 74*a*, 74*b*, 74*c*, 74*d* depict the condition and displacement of liner 63 at consecutive instants in time after detonation. The explosively formed rings do not have to be continuous in order to have a cutting capability. Indeed, for targets such as brick walls or aluminum plates, cutting can be achieved by the ring fragments provided that at a given slant range there is enough fragment density and energy to cut through the target. Therefore, as previously mentioned, the cutting capability of the ring elements depends on their slant range to the target, which is determined by the warhead detonation standoff distance and obliquity. As discussed above with reference to FIG. 4, charge 50 produces a blast wave that induces a strong shock in the target. For brittle targets, such as concrete or brick walls, such shock can have a scabbing effect breaking the rear layers of the target. The combination of the scabbing effect of the blast wave and the cutting effect of the explosively-formed rings impacting the target at close sequence provides a very effective breaching mechanism, also knocking out the weakened front layer.

The DEFR serves as a cutting charge in various applications, including defeating light armored vehicles and breaching concrete and brick walls. One of the preferred methods to bring the DEFR warhead onto the target is installing it onto an airframe, such as a rocket, a missile or a projectile (all of them to be hereinafter referred to as a "projectile"). Such a projectile will also include a standoff device, such as a standoff rod or proximity fuse, a Safety-and-Arming device and a projectile airframe or body including stabilization devices such as fins.

Figure 6A:
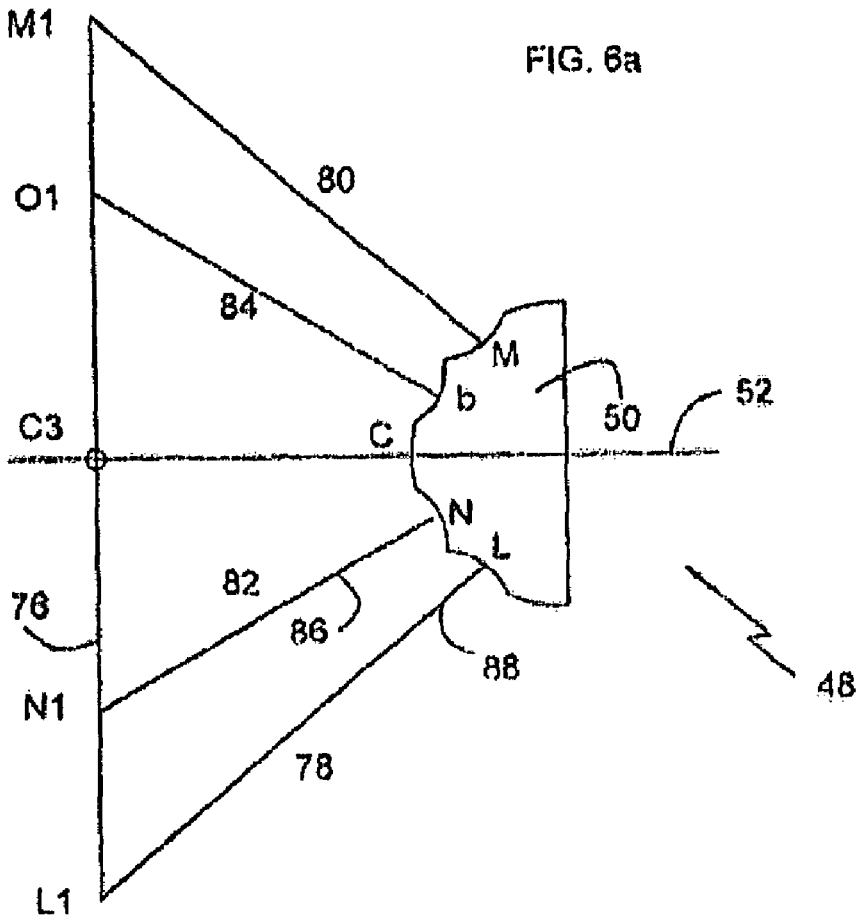
FIG. 6*a* is a schematic cross-sectional view of the DEFR warhead of FIG. 4 shortly after detonation, where the axis of the warhead is aligned perpendicular to the surface of a target.

Reference is now made to FIG. 6*a*, which is a schematic cross-sectional view of warhead 48 of FIG. 4 shortly after detonation, at a standoff distance $CC_3$ from a target 76, when axis 52 of warhead 48 is aligned perpendicular to the surface of target 76. Target 76 is typically a brick wall. Warhead 48 produces an inner ring 86 and an outer ring 88. The slant ranges $LL_1$ and $MM_1$ traveled along cone generatrices 78 and 80, respectively, by the various elements of outer ring 88 are equal to each other. The slant ranges $NN_1$ and $OO_1$ traveled along cone generatrices 82 and 84, respectively, by the various elements of inner ring 86, are equal to each other. It should be noted that the slant ranges traveled by the elements of outer ring 88 are longer than those traveled by the elements of inner ring 86.

Figure 6B:
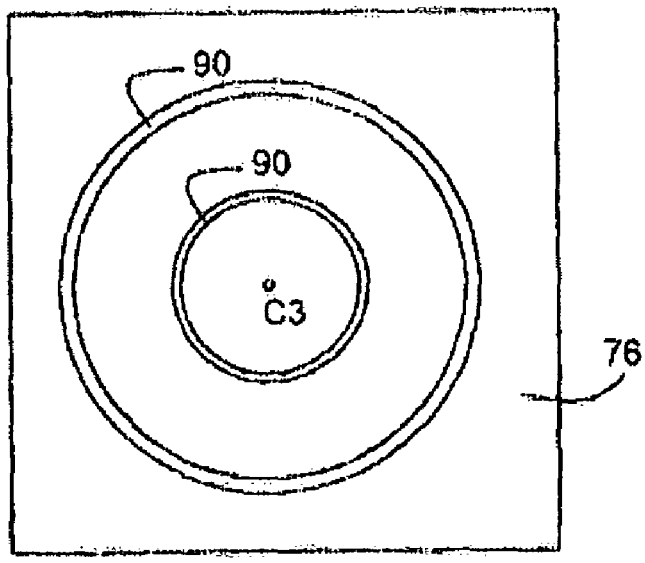
FIG. 6*b* is a schematic front view of the footprints formed by the DEFR warhead on the target of FIG. 6*a;*

Reference is now made to FIG. 6*b*, which is a schematic front view of target 76 and a footprint 90 and a footprint 91 formed by warhead 48 on target 76, due to the detonation of warhead 48 as described with reference to FIG. 6*a*. Footprint 90 and footprint 91 of liner 62 and liner 63 (FIG. 4), respectively, on target 76 are circular. Target 76 is evenly cut around the circumferences of footprints 90, 91.

Figure 6C:
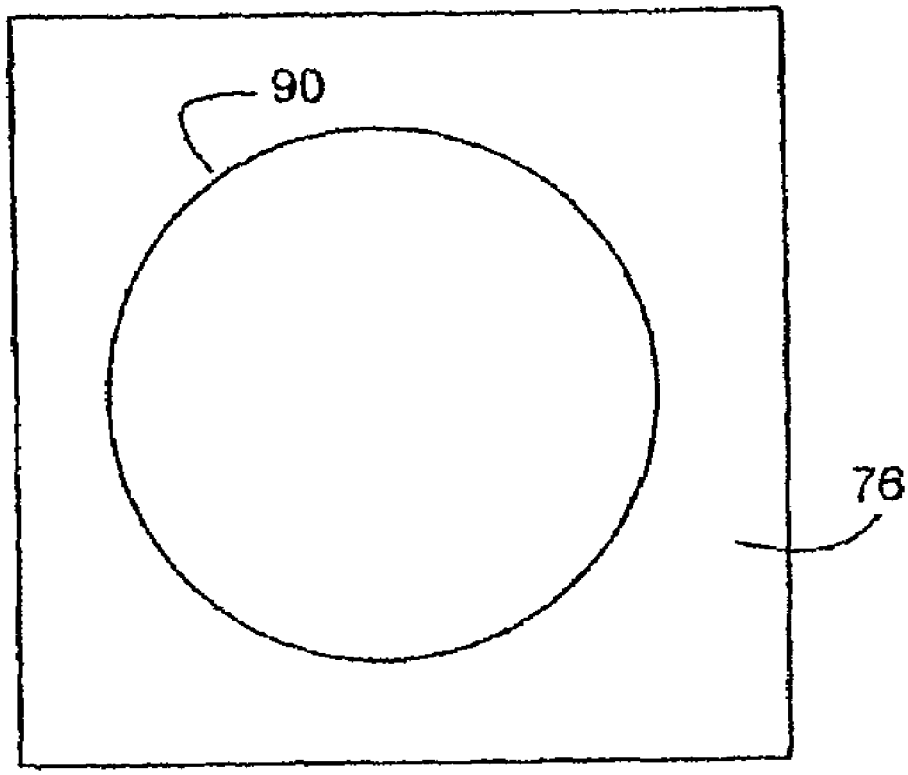
FIG. 6*c* is a schematic front view of the final damage caused to the target of FIG. 6*a;*

Reference is now made to FIG. 6*c*, which is a schematic front view of the final damage caused to target 76 due to the detonation of warhead 48 as described with reference to FIG. 6*a*. The blast wave generated by charge 50 impinges on the portion of target 76 inside footprint 91, creating a hole in target 76.

Reference is now made to FIG. 7*a*, which is a schematic cross-sectional view of warhead 48 of FIG. 4 shortly after detonation, at a standoff distance $CC_4$ from a target 92, where axis 52 of warhead 48 is aligned obliquely to a surface of target 92 during detonation of charge 50. Target 92 is typically a brick wall. Slant ranges $LL_2$, $MM_2$ and $NN_2$, $OO_2$ traveled along cone generatrices 94, 96, 98 and 100, respectively, by the various elements of the rings, are not equal to each other.

Reference is now made to FIG. 7*b*, which is a schematic front view of target 92 and a plurality of footprints 102, 104 formed by warhead 48 on target 92, where warhead 48 was detonated as described with reference to FIG. 7*a*. Footprint 102 is formed by liner 62 (FIG. 4) and footprint 104 is formed by liner 63 (FIG. 4). Footprint 102 and footprint 104 are generally an elliptical shape. Target 92 is unevenly cut around the circumferences of footprints 102 and 104. For any cross-section of warhead 48 coplanar with axis 52, the slant ranges traveled by the elements associated with outer annular portion 60 are longer than those traveled by the elements associated with inner annular portion 58 for any given divergence angle from axis 52. For this reason, better cutting performance is achieved along footprint 102 associated with inner annular portion 58 than along footprint 104 associated with outer annular portion 60. Specifically, the entirety of footprint 102 and only part of footprint 104 are cut through target 92. Target 92 is cut through at point $L_2$ on footprint 104, which corresponds to liner 62 associated with outer annular portion 60 impacting at the shortest slant range $LL_2$ (FIG. 7*a*). Similarly, along elliptical curves $L_2R_2$ and $L_2S_2$ of footprint 104, target 92 is cut through. On the other hand, at point $M_2$ on footprint 104, which corresponds to liner 63 of outer annular portion 60 impacting at the longest slant range $MM_2$ (FIG. 7*a*). Similarly, along elliptical curves $M_2R_2$ and $M_2S_2$, the energy of fragments of liner 63 of outer annular portion 60 is insufficient to cut through target 92. At point $M_2$ and nearby, the fragments of liner 63 causes only superficial dents. Moving from point $M_2$ towards points $R_2$ and $S_2$, respectively, the depth of the dents increases gradually until at points $R_2$ and $S_2$, respectively, the dent depth is sufficient to cut through target 92.

Reference is now made to FIG. 7*c*, which is a schematic front view of the final damage caused to target 92 due to the detonation of warhead 48 as described with reference to FIG. 7*a*. The blast wave generated by charge 50 impinges on the portion of the target inside the cut through part of footprint 104 creating a connection 106 between footprint 102 and footprint 104, thereby creating a hole in target 92. It should be noted that a hole created only by footprint 102 is not large enough for the required use, such as allowing entry of personal or warheads though the hole. However, the hole created by the combination of footprint 102 and footprint 104 is large enough for the required use.

If the blast wave generated by charge 50 impinging on the portion of target 92 within the cut through part of footprint 104 fails to knock out that part of target 92, it will at least weaken it. In such cases, an additional DEFR warhead is directed towards target 92, thereby generating additional footprints in target 92 and also creating connection 106 between footprint 102 and footprint 104 thereby breaching the target.

It will be appreciated by persons skilled in the art that the present invention is not limited to what has been particularly shown and described hereinabove. Rather, the scope of the present invention includes both combinations and sub-combinations of the various features described hereinabove, as well as variations and modifications thereof that are not in the prior art which would occur to persons skilled in the art upon reading the foregoing description.

What is claimed is:

1. A warhead configuration for forming a hole through a wall of a target, the warhead configuration comprising:

(a) a charge of explosive material, said charge having an axis and a front surface, said front surface including two annular front surface portions circumscribing said axis, one of said annular front surface portions being an inner annular portion, another of said annular front surface portions being an outer annular portion, said inner annular portion being disposed between said axis and said outer annular portion, each of said two annular front surface portions being configured so as to exhibit a concave profile as viewed in a cross-section through said charge parallel to said axis, at least part of said concave profile of each of said two annular front surface portions being configured such that a vector projecting outward from said part in a direction normal to said annular front surface portion diverges from said axis; and (b) a liner including a first liner disposed adjacent to at least part of said inner annular portion and a second liner disposed adjacent to at least part of said outer annular portion, said charge and said liner being configured such that, when said charge is detonated, material from said first liner is formed into a first forward-directed expanding explosively formed ring and material from said second liner is formed into a second forward-directed expanding explosively formed ring, wherein said inner and outer annular front surface portions and said liner are configured such that, when the warhead is detonated with said front surface proximal to a plane and said axis inclined at an angle relative to a line orthogonal to said plane, said first and second expanding explosively formed rings impinge on said lane so as to define inner and outer generally-elliptical footprints, respectively, on said plane.

2. The warhead configuration of claim 1, wherein:

(a) a first average vector is defined as the vector average of two vectors projecting normally outward from opposite extremes of said concave profile of said inner annular portion;

(b) a second average vector is defined as the vector average of two vectors projecting normally outward from opposite extremes of said concave profile of said outer annular portion;

(c) a first angle is defined as an angle between said first average vector and said axis;

(d) a second angle is defined as an angle between said second average vector and said axis; and (e) said second angle exceeds said first angle by at least 5°.

3. The warhead configuration of claim 1, wherein:

(a) said first expanding explosively formed ring exhibits a first expanding conical path having a first angle relative to said axis;

(b) said second expanding explosively formed ring exhibits a second expanding conical path having a second angle relative to said axis; and (c) said second angle exceeds said first angle by at least 5 degrees.

4. The warhead configuration of claim 1, wherein said two annular front surface portions are substantially rotationally symmetric about said axis.

5. The warhead configuration of claim. 1, wherein said concave profile corresponds substantially to an arc of a circle.

6. The warhead configuration of claim 5, wherein said arc subtends an angle of between 15° and 90° to a center of curvature of said arc.

7. The warhead configuration of claim 5, wherein said arc subtends an angle of between 30° and 70° to a center of curvature of said arc.

8. The warhead configuration of claim 1, wherein said concave profile turns through an angle of between 15° and 90°.

9. The warhead configuration of claim 1, wherein said concave profile turns through an angle of between 30° and 70°.

10. The warhead configuration of claim 1, wherein said two annular front surface portions correspond to at least about two-thirds of the total front surface of said charge as viewed parallel to said axis.

11. The warhead configuration of claim 1, wherein said two annular front surface portions correspond to at least about 90% of the total front surface of said charge as viewed parallel to said axis.

12. The warhead configuration of claim 1, wherein said charge and said liner are configured such that detonation of said explosive material imparts a velocity to said liner of between about 1000 and about 4000 meters per second.

13. The warhead configuration of claim 1, further comprising a central portion adjacent to said central axis having a generally convexly curved shape.

14. The warhead configuration of claim 1, wherein said charge includes between about 1 kg and about 3 kg of explosive material.

15. The warhead configuration of claim 1, wherein said charge includes less than about 2 kg of explosive material.

16. The warhead configuration of claim 1, further comprising a stand off detonation system including means for defining a stand off detonation distance of said charge from the wall.

17. The warhead configuration of claim 16, wherein said means for defining a stand off detonation distance includes a stand off rod projecting from said front surface substantially parallel to said axis.

18. The warhead configuration of claim 1, wherein said charge has a rear surface, the warhead further comprising a rear cover associated with at least said rear surface, said rear cover being formed from a non-fragmenting material.

19. A warhead configuration for forming a hole through a wall of a target, the warhead configuration comprising:

(a) a charge of explosive material, said charge having an axis and presenting a front portion; and (b) a liner disposed adjacent to at least part of said front portion, wherein said charge and said liner are configured such that, when said charge is detonated, a majority of material from said liner forms two forward-directed expanding explosively formed rings, wherein said charge and said liner are configured such that, when the warhead is detonated with said front portion proximal to a plane and said axis inclined at an angle relative to a line orthogonal to said plane said two expanding explosively formed rings impinge on said plane so as to define two distinct generally-elliptical footprints on said plane.

20. The warhead configuration of claim 19, wherein:

(a) one of said two expanding explosively formed rings exhibits a first expanding conical path having a first angle relative to said axis;

(b) another of said two expanding explosively formed rings exhibits a second expanding conical path having a second angle relative to said axis; and (c) said second angle exceeds said first angle by at least 5 degrees.

* * * * *